US005183479A

United States Patent [19]

Grimes

[11] Patent Number: 5,183,479

[45] Date of Patent: Feb. 2, 1993

[54] ABRASIVE DISKS AND METHOD OF MAKING

[75] Inventor: John R. Grimes, Etobicoke, Canada

[73] Assignee: Gemtex Company Limited, Etobicoke, Canada

[21] Appl. No.: 785,330

[22] Filed: Nov. 1, 1991

[51] Int. Cl.[5] ..... D24D 3/00

[52] U.S. Cl. ..... 51/293; 51/295; 51/406; 427/290; 427/292

[58] Field of Search ..... 51/293, 295, 406; 427/290, 292

[56] References Cited

U.S. PATENT DOCUMENTS

| | | | |
|---|---|---|---|
| 3,267,623 | 8/1966 | Block | 51/406 |
| 3,849,949 | 11/1974 | Steinhauser et al. | 51/406 |
| 3,959,935 | 6/1976 | Stoppacher | 51/406 |
| 4,274,232 | 6/1981 | Wylde | 51/406 |
| 4,481,016 | 11/1984 | Campbell et al. | 51/293 |
| 4,652,274 | 3/1987 | Boettcher et al. | 51/295 |
| 4,826,508 | 5/1989 | Schwartz et al. | 51/293 |
| 4,925,457 | 5/1990 | DeKok et al. | 51/293 |
| 5,000,761 | 3/1991 | Mayton et al. | 51/295 |
| 5,011,512 | 4/1991 | Wald et al. | 51/295 |
| 5,015,266 | 5/1991 | Yamamoto | 51/293 |
| 5,096,465 | 3/1992 | Chen et al. | 51/293 |

*Primary Examiner*—William R. Dixon, Jr.
*Assistant Examiner*—Willie J. Thompson

[57] ABSTRACT

Disks for heavy grinding are made by stamping uncoated backing material to provide a plurality of interconnected disk shapes. The shapes are notched or weakened for separation. The interconnected shapes are then covered with abrasive embedded in adhesive.

11 Claims, 2 Drawing Sheets

ABRASIVE DISKS AND METHOD OF MAKING

Figure 1:
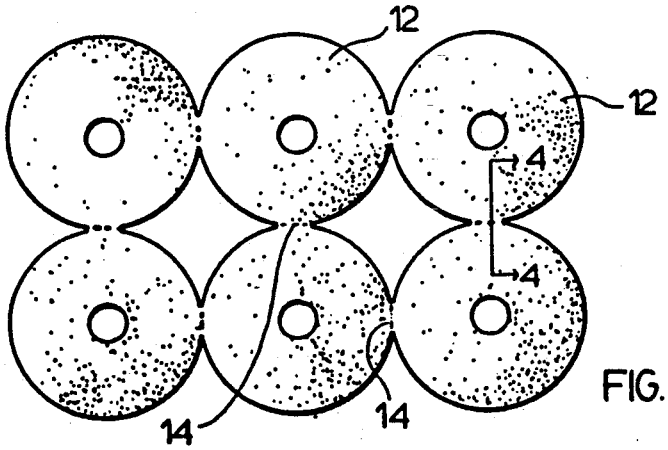

This invention relates to coated abrasive shapes and the method of making such shapes for the order of 10,000–15,000 RPM for use on machines such as heavy grinding machines and the like. The shapes with which the invention is concerned are provided with a aperture for mechanical mounting on a base surface.

The abrasive product made in accord with this invention is a suitable backing material available in sheet embedded in such adhesive.

Because of the speed (of the order of 10,000–15,000 RPM) at which such grinding machines operate, the backing material has had to be made of material greater than 0.010" (ten thousandths of an inch) in thickness and preferably of material of the order of 0.025"–0.040" (twenty-five to forty thousandths of an inch). Backing materials may include the chocolate olive vulcanized abrasive fibre mentioned in the preferred embodiment, laminated fibre sheets, plastic alloy materials, laminated paper and other suitable backing materials all of the required thickness.

Thus, the 'shapes' referred to herein are two dimensional outlines of the backing material with abrasive-containing coating on one side or may be coated on both sides.

A large proportion of the shapes made in accord with the invention will be circular discs (plus connecting material as hereinafter explained) for use on rotary tools and grinders. the disks may be octagonal or hexagonal. The disks will have a central aperture for mounting. (usually by a nut screwed on a bolt extending through the centre aperture). However, the shapes may be other than circular as noted herein.

The older prior art method of making circular shaped coated abrasive products on a backing sheet was to apply the adhesive binder and the abrasive grit to one side of a wide roll of backing material such as paper, cloth, plastic or fibre, etc. After the coating, drying and curing processes, the finished roll is placed in a punch press cutting machine and the discs or shapes are stamped out, leaving a lattice work of perfectly good coated abrasive material as waste that must be disposed of environmentally. The 'punching out' or cutting of shapes from coated abrasive products also creates an extreme amount of wear and tear on the punching and cutting machinery.

A newer prior art method was developed to overcome the two major disadvantages of the older method described above. This newer method involved cutting the desired product shaped in the backing material in advance of the adhesive and grit to form the finished product. This newer prior art method not only avoided the wear and tear on the punching or cutting machinery, but also virtually eliminates the adhesive and abrasive material that is wasted, as noted, when using the other method.

Disadvantages of the newer prior art method are the expense and time delay in handling the individual backing and product shapes during the coating, curing and subsequent manufacturing or finishing steps. Although the following example does not express the full extent of this problem, it is noted that for example, equal handling time is required to handle a disc, and the individual handling of both is inconvenient and time consuming.

U.S. Pat. Nos. 3,267,623 of Aug. 8, 1966 and 3,849,949 of Nov. 26, 1984 disclose connected abrasive-coated disks for detachment and individual use. However such disks are in practice directed to light grinding or finishing operation at about 500 RPM and because such are the uses, the thickness of the backing materials is about 0.003" being attached to sanding pads by a pressure sensitive adhesive. In contrast the disks or abrasive shapes with which applicant is concerned are used for heavy grinding at speeds of the order of 10,000–15,000 RPM and the backing material is greater than 0.010" in thickness and preferably about 0.025"–0.040" thick and being attached to grinders by mechanical means.

The U.S. Pat. Nos. 3,267,623 and 3,849,949 refer to a method of production which involves material, already coated with abrasive, and any other coatings required before being cut into connected disks and before the provision of any weakened detaching material is first cut into connected disks or other shapes, before being provided with abrasive and/or other coatings. This if for the reasons discussed in paragraph 6 of this application. Moreover, the 'nicking' or weakening of the backing material is, in applicant's method, also performed before the coating step so that wear on the operating machinery is lessened. It is found that without this weakening at the connection point; the disks, after coating with abrasive and curing; will not break apart cleanly.

Accordingly, in accord with this invention, our novel method comprises stamping out from an uncoated backing sheet a first plurality of apertured shapes interconnected at suitable locations so that they are arranged in an orderly pattern or array during the coating steps. The percentage of the periphery of the backing material shape having connecting material to another shape is less than 10%, preferably less than 5% and ideally about 1%–2%. If cuts or nicks or other means are used to weaken the backing material between adjacent disks then such cuts, nicks or other weakening is performed by appropriate machinery just after the stamping out of the shapes or simultaneously therewith. This first plurality of connected shapes (or a second plurality forming a sub-group of the first) is then coated with abrasive embedded in adhesive, cured and subjected to the normal finishing processes. Thus the connected arrangement of a number of shapes may be maintained through all the coating and processing steps, and in fact a number of the shapes may still be attached when the product is sold to the customer. The reason for having a first plurality and a second which may be a sub-group of the first is to cover the possibility that it may be desirable to stamp out the backing material in a large two dimensional array—for examples: rows and columns of members: or a hexagonal arrangement of circular discs, in either case being the first plurality: then performing the remaining process steps on a smaller array detached from the first, say a single row of connected shapes.

The process as described in the previous paragraph has the advantage that the loss of abrasive and adhesive is negligible since a large percentage of the coated material forms a usable part of the finished individual (shape). On the other hand, the handling and processing time is saved since a group of connected shapes are processed together. In each step from the coating to the final packaging and shipping for use, handling and processing time is saved if the shapes remain attached. The novel process also shares with the newer prior method the advantage that, since the backing material is stamped or cut while uncoated, wear and tear on the corresponding cutter or punch press is avoided.

It is therefore an object of this invention to provide an abrasive coated product comprising the steps of: stamping backing material to form a first plurality of interconnected shapes corresponding to those for finished abrasive products, where the proportion of the periphery of each shape having connecting material to other shapes is less than 10% and taking such plurality or a connected sub-group thereof through the necessary process steps to provide a coated backing with abrasive grit embedded therein and subsequently converting these pluralities of connected shapes into finished abrasive disc like products.

It is an object of a preferred facet of the invention to provide the process above-described wherein the connected shapes have a periphery at the connecting point area of less than 10% and preferably about 1% to 2% that is relatively flat as opposed to the curvature of the shape.

It is an object of a preferred facet of the invention to provide the process first described where the circular shapes are connected along mutually orthogonal lines. This provides for greatly simplified separation of an array of shapes into rows or into individual shapes.

It is an object of a preferred facet of the invention to provide the process first described where the uncoated backing cut into connected shapes is provided with weakened lines for separation at the connection as required for finished coated abrasive products.

So far as saving of backing material, abrasive material and adhesive, the proportion of the periphery of a shape which connects to each adjacent shape in an array will be as small as possible. The lower limit for such proportion will be set by the fact that there must be sufficient connecting material to avoid breakage between connected shapes of backing without or with abrasive coating during and after the manufacturing process. For example with a 4 inch diameter disc, we have found that only a ⅛" extent of periphery (about 1% of the circumference) is required for connection to any adjacent disc. However, it will be noted that for a 9 inch disc, although the periphery has approximately doubled, the area (and hence the weight of backing or abrasive) has increased by a factor of 5. Thus the proportion of the periphery used for connection may have to be higher with a larger disc and will be affected by the weight of abrasive used. However, for basically circular shapes the proportion can be less than 10%.

It is an object of the invention to provide products resulting from the processes of the foregoing three paragraphs.

Figure 2:
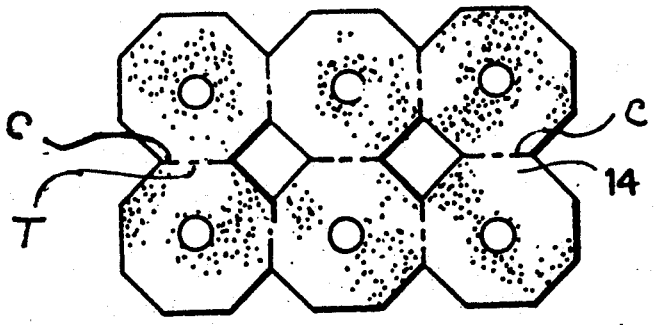
Figure 3:
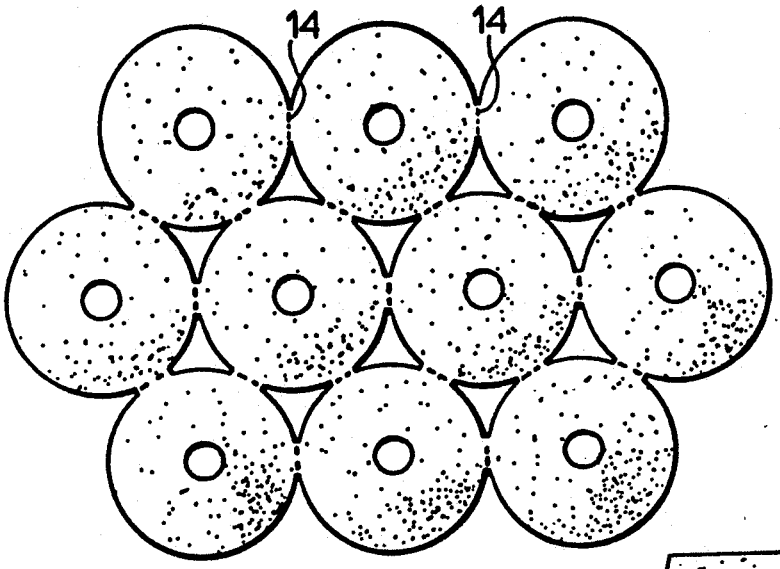
Figure 4:
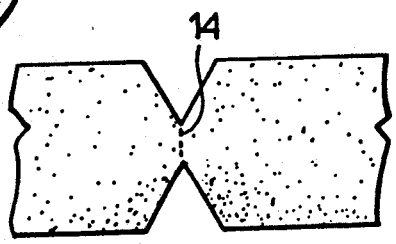
Figures 5, 5A:
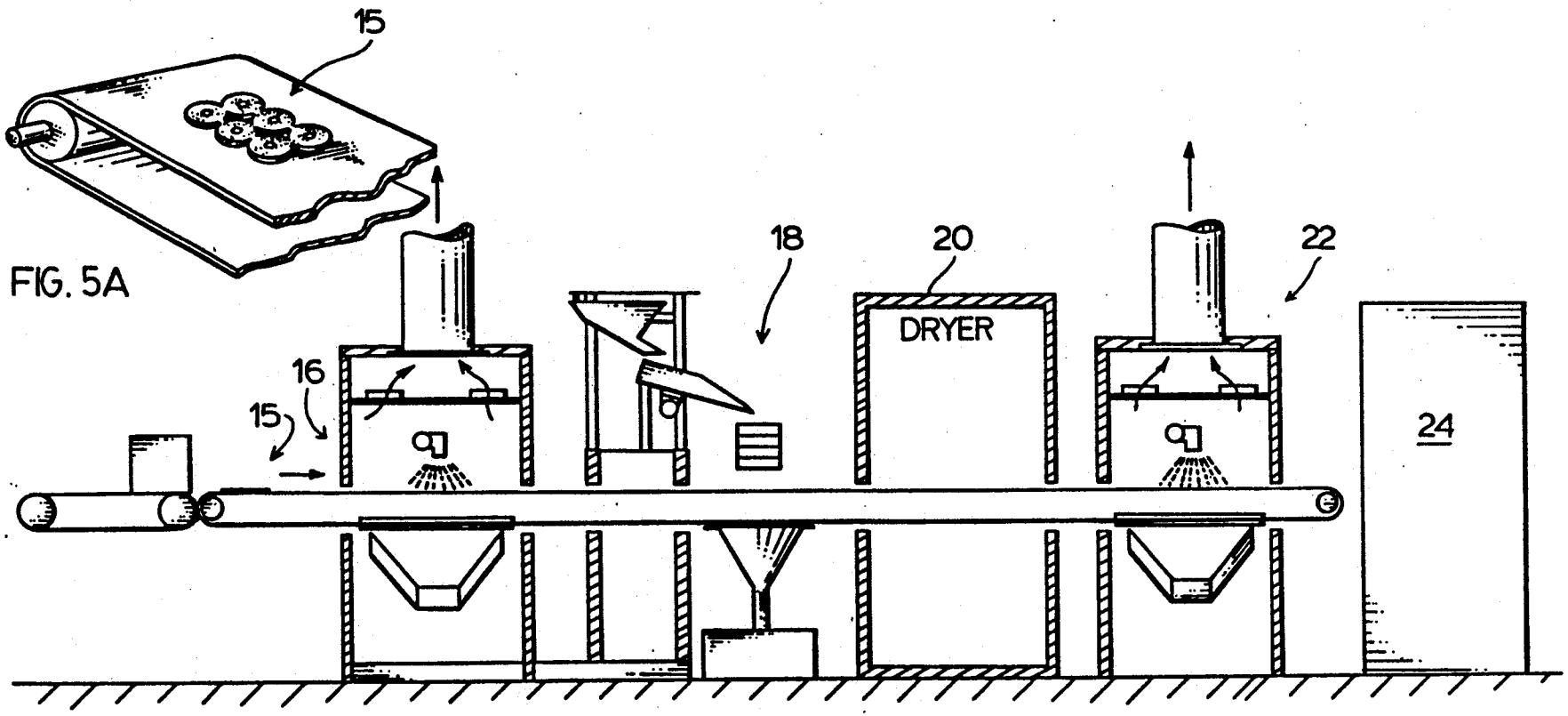

In drawings which illustrate a preferred embodiment of the invention:

FIG. 1 shows a rectilinear array of connected circular or disc shapes in accord with the invention, FIG. 2 shows an array of connected octagonal shapes in accord with the invention, FIG. 3 shows a hexagonal array of circular shapes, FIG. 4 shows a section along the lines 4—4 of FIG. 1, FIG. 5 shows a production line in accord with the invention, FIG. 5A shows a perspective of a portion of the line of FIG. 5.

In drawings FIG. 1 shows as preferred form of the interconnected shapes. A web of backing was used to stamp out a connected arrangement of 6 circular discs 12 in a 3×2 rectilinear array. The stamping process included the simultaneous stamping of centre apertures 11 for receiving the shank of a mounting bolt so that the shapes may be mounted by a nut tightened onto the bolt. The array may be of any size. The circular shapes are spaced just wider than the spacing for co-tangency and at each connection of one disc to a single other disc, the connecting blank material is left to connect 1–2% of the disc circumference. The discs are customarily provided 4" with a ⅝" centre hole 11.

The backing material is greater than 0.010 inches thick and is preferably chocolate-olive abrasive fibre thickness of 0.030 inches which is available from National Vulcanized Fibre Company of Yorklyn, Del. Any suitable backing material may however be used. The connected shapes are customarily made from the backing material in a punch press cutting machine. It will be noted that the connected shapes are arranged so that they may be separated along mutually orthogonal lines.

The scope of the invention is however independent of the connected shape which may be of any form for which coated abrasive on a backing is required.

After the stamping of one of the shapes shown in FIGS. 1, 2 or 3; or different shapes or a different array, the array may be subject to a second cutting process in a punch press wherein each line corresponding to the junction of the thickness, leaving ⅓ of the thickness still intact and Joined as shown in FIG. 4. The second cutting operation if required is designed to weaken the connection between the shapes for later separation.

Thus the second cutting operation may be replaced by any other conventional method such as scoring or perforating for weakening the separation line 14 for future separation. In an alternative to the second cutting operation, it may be preferred to use a single pass operation where the stamping out of connected shapes is combined with the partial cutting of the connecting lines.

However it is found that unless the connection between shapes is weakened before the backing material is coated and covered with adhesive the shapes and disks do not break apart cleanly.

Also it should be noted that the array after the second cutting operation may be a different shape from that processed in the further steps to be described. Thus for example, it might be desired to form 36 discs in a 6×6 rectilinear array in the first and second cutting operation and then separate such strips into six rows of six (or into a 3×2 array) for further processing. With the materials shown, we have found that such separation may be performed by a 45° bending operation performed by any conventional means.

Where the shapes are polygons, as with the octagon of FIG. 2 the separation line 14 may be formed of complete cuts C at each end with a very narrow connecting tab T.

The connected unit being an array of the first plurality of shapes or sub-array of a smaller second plurality of shapes, as selected, is then subjected to the conventional processing steps as shown in FIGS. 5 and 5A. The array or sub-array 15 or a group of them are passed through a conventional spray line adhesive coater 16, after which it is subjected to a conventional electrostatic application of abrasive grain at application 18. The arrays 15 are then subjected to a conventional drying process in dryer 20, followed by a second coating of adhesive in a conventional spray line adhesive coater 22 followed by a high temperature cure in oven 24 to complete the manufacturing cycle.

It will be noted that all the steps of the manufacturing process are conventional and performed by conventional equipment. However, it also should be noted that the spray line adhesive coaters 16 or 22 recover the adhesive which does not come to rest on the backing. It is for this reason that savings are achieved with the inventive connected array since substantially all adhesive which misses the array is reclaimed below the coating area for re-use. Similar considerations apply to the electrostatic applicator 18. Abrasive grit from the applicator 18 which does not come to rest on the adhesive, falls into a recovery area for re-use.

Any conventional method for applying the abrasive carrying adhesive will be within the scope of the invention. However, only those methods which allow reclamation of adhesive and grit which is dispensed but not used will achieve the full advantages of the invention in this area. However, even without such reclamation, the labor saving aspects of the invention involved in easier handling of the arrays or sub-arrays still apply.

The manufactured unit from oven 24 is then conventionally placed in a humidity chamber to condition and normalize the product and this step is customarily followed by passing the unit between a rubber and steel pressure roll and finally through a printing machine to mark the back side of the product with pertinent information.

The unit may then be separated into individual abrasive units or into connected sub-groups for sale. With the second cut shown in FIG. 4, we have found that a 45° bend will separate the shapes along any of the separation lines.

It will have been noted that products of the inventive process have small amounts of connecting material. (extending to line 14) about small extents of the desired shape. This has not been found to interfere with the operation of the product, whether rotating or non rotating.

We claim:

1. Method of making abrasive coated product comprising the step of:

providing a first plurality of interconnected shapes, with mounting apertures, where the proportion of the periphery of each such shape having connecting material to each connected shape is less than 10%, providing a second plurality of said connected shapes with an adhesive coat, wherein said second plurality may be less or equal said first plurality, then applying abrasive grit to said adhesive coat, then providing a second adhesive coat over said grit carrying first adhesive coat.

2. Method as claimed in claim 1 wherein said shapes are circular and the proportion of the periphery of each circle having connecting material to a single other disc is less than 10%.

3. Method as claimed in claim 1 wherein said shapes are circular and the proportion of the periphery of each circle having connecting material to a single other disc is about 1–2%.

4. Method as claimed in claim 1 wherein said first plurality of said shapes connected in an array along mutually orthogonal lines which do not cross any such shapes.

5. Method as claimed in claim 2 wherein said first plurality of said shapes connected in an array along mutually orthogonal lines which do not cross any such shapes.

6. Method as claimed in claim 3 wherein said first plurality of said shapes connected in an array along mutually orthogonal lines which do not cross any such shapes.

7. Method as claimed in claim 1 including the step prior to said first adhesive coating step of weakening the connection between the then interconnected shapes.

8. Method as claimed in claim 2 including the step prior to said first adhesive coating step of weakening the connection between the then interconnected discs.

9. Method as claimed in claim 3 including the step prior to said first adhesive coating step of weakening the connection between the then interconnected discs.

10. Method as claimed in claim 4 including the step prior to said first adhesive coating step of weakening the connection between the then interconnected discs.

11. Method as claimed in claim 6 including the step prior to said first adhesive coating step of weakening the connection between the then interconnected discs.

* * * * *